US008584918B2

(12) United States Patent
Su et al.

(10) Patent No.: US 8,584,918 B2
(45) Date of Patent: Nov. 19, 2013

(54) FRACTURING APPARATUS

(75) Inventors: Chih-Chieh Su, Hsinchu (TW); Sheng-Hong Tsai, Hsinchu (TW); Tyng-Bin Huang, Hsinchu (TW)

(73) Assignee: Ritek Corporation, Hsinchu (TW)

( * ) Notice: Subject to any disclaimer, the term of this patent is extended or adjusted under 35 U.S.C. 154(b) by 183 days.

(21) Appl. No.: 13/348,649

(22) Filed: Jan. 12, 2012

(65) Prior Publication Data

US 2013/0181026 A1 Jul. 18, 2013

(51) Int. Cl.
*B26F 3/00* (2006.01)

(52) U.S. Cl.
USPC ..... 225/23; 225/96.5

(58) Field of Classification Search
USPC ..... 225/2, 96.5, 94, 6, 23
See application file for complete search history.

(56) References Cited

U.S. PATENT DOCUMENTS 5,297,710 A * 3/1994 Juras ..... 225/2
6,463,762 B1 * 10/2002 Ross, Jr. ..... 65/105
6,616,025 B1 * 9/2003 Andrewlavage, Jr. ..... 225/96.5
7,204,400 B2 * 4/2007 Marek et al. ..... 225/1
8,292,141 B2 * 10/2012 Cox et al. ..... 225/2
8,496,150 B2 * 7/2013 Lee et al. ..... 225/94
2003/0205604 A1 * 11/2003 Matsuzawa ..... 225/96.5
2004/0050894 A1 * 3/2004 Andrewlavage, Jr. ..... 225/1
2009/0050661 A1 * 2/2009 Na et al. ..... 225/2
2009/0061597 A1 * 3/2009 Mendoza et al. ..... 438/462
2012/0241488 A1 * 9/2012 Kang et al. ..... 225/2

* cited by examiner

*Primary Examiner* — Sean Michalski
(74) *Attorney, Agent, or Firm* — CKC & Partners Co., Ltd.

(57) ABSTRACT

A fracturing apparatus is provided. The fracturing apparatus includes a first board portion, a pressing element, a first suction device, a second board portion, a second suction device, and a cylinder. The first suction device is secured to the first board portion. The second board portion is rotatably connected to the first board portion. The second suction device is secured to the second board portion. The pressing element is secured to the first board portion and disposed between the first board portion and the second board portion. The cylinder is located on the first board portion and includes a piston rod rotatably connected to the second board portion. When the piston rod extends, the second board portion is pressed by the piston rod and swiveled about the first board portion.

16 Claims, 7 Drawing Sheets

FRACTURING APPARATUS

BACKGROUND

1. Technical Field

The present disclosure relates to a fracturing apparatus.

2. Description of Related Art

Photovoltaic (PV) modules convert light energy into electrical energy without producing any greenhouse gases during the conversion process. Therefore, energy may be obtained in a more environmentally friendly manner. The electrical energy generated by photovoltaic modules can be used for all the different kinds of applications as can electrical energy derived using batteries or existing power generators. Recently, with the progress and development in photovoltaic technology, the cost of PV modules has dropped considerably, thereby rendering PV modules more affordable and more popular in the consumer market. For example, PV modules can now be found on residence rooftops and on the external walls of buildings, as well as in various electronic products such as mobile phones, personal digital assistants, digital watches, and laptops.

A PV module utilized in a consumer electronic product generally includes many PV cells having different sizes. The PV cells are formed by cutting and are connected in series. One method for cutting the PV cells is laser cutting. However, when a laser directly cuts a PV cell into two sections, the regions near the cut surfaces of the PV cell may melt and be short-circuited as a result of the significant heat generated during the cutting process.

In order to avoid short circuits, a groove may first be formed on a PV cell by laser, after which the PV cell may be manually fractured along the groove by an operator. Because the material of the PV cell is brittle and different operators may apply different forces during such a fracturing process, uneven cracks frequently are formed on the PV cell. Moreover, the quality and yield of the PV cells are difficult to control.

In recent years, due to the intense competition in manufacturing industries, manufacturers that are able to produce more products in a limited time have better market competitiveness. Therefore, the importance of automatic equipment grows with each passing day.

SUMMARY

An aspect of the present invention is to provide a fracturing apparatus.

In an embodiment of the present invention, a fracturing apparatus includes a first board portion, a pressing element, a first suction device, a second board portion, a second suction device, and a cylinder. The first suction device is secured to the first board portion. The second board portion is rotatably connected to the first board portion. The second suction device is secured to the second board portion. The pressing element is secured to the first board portion and disposed between the first board portion and the second board portion. The cylinder is located on the first board portion and includes a piston rod rotatably connected to the second board portion. When the piston rod extends, the second board portion is pressed by the piston rod and swiveled about the first board portion.

In an embodiment of the present invention, the fracturing apparatus further includes a moving device connected to the first board portion for controlling a moving direction of the first board portion.

In an embodiment of the present invention, the fracturing apparatus further includes a first fixing element. The first board portion includes a first positioning hole, and the second board portion includes a second positioning hole corresponding to the first positioning hole. The first fixing element extends through the first board portion and the second board portion through the first positioning hole and the second positioning hole.

In an embodiment of the present invention, the first fixing element includes a bolt.

In an embodiment of the present invention, the second board portion includes a connecting part connected to the piston rod.

In an embodiment of the present invention, the fracturing apparatus further includes a second fixing element penetrating the connecting part and the piston rod.

In an embodiment of the present invention, the second fixing element includes a bolt.

In an embodiment of the present invention, the second board portion and the connecting part are formed as a single piece.

In an embodiment of the present invention, the first suction device includes a first nozzle.

In an embodiment of the present invention, the second suction device includes a second nozzle.

In an embodiment of the present invention, the first nozzle, the second nozzle, and the pressing element have respective end surfaces disposed substantially within the same horizontal level when the piston rod does not extend.

In an embodiment of the present invention, the material of the first board portion and the second board portion includes aluminum or stainless steel.

In an embodiment of the present invention, the material of the pressing element includes plastic or rubber.

In an embodiment of the present invention, the pressing element has a rectangular cross section.

In an embodiment of the present invention, the first board portion has an L-shaped cross section.

In an embodiment of the present invention, the second board portion has an L-shaped cross section.

In the aforementioned embodiment of the present invention, when the first suction device located on the first board portion and the second suction device located on the second board portion adhere to a substrate having a groove formed therein, the substrate may be placed on a block, such that the substrate is sandwiched between the pressing element and an edge of the block. Moreover, the edge of the pressing element is adjacent to the groove of the substrate and the edge of the block is approximately and vertically aligned with the edge of the pressing element. Subsequently, the piston rod of the cylinder may extend in response to reception of an electric signal by the cylinder, such that the second board portion is pressed by the piston rod and swiveled about the first board portion. Therefore, the substrate is fractured along the groove and divided into two portions.

As a result, one of the two portions of the substrate remains sandwiched between the pressing element and the edge of the block and is adhered to by the first suction device, and the other one of the two portions of the substrate is adhered to by the second suction device.

With such a design, the fracturing apparatus including the first suction device, the second suction device, and the cylinder operates automatically to fracture the substrate. As a result, the cut surfaces of the two portions of the substrate are smooth. Therefore, uneven cracks do not easily form on the substrate. Furthermore, when utilizing the fracturing apparatus to fracture a large number of substrates, the quality, yield and capacity of the divided substrates are easy to control.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
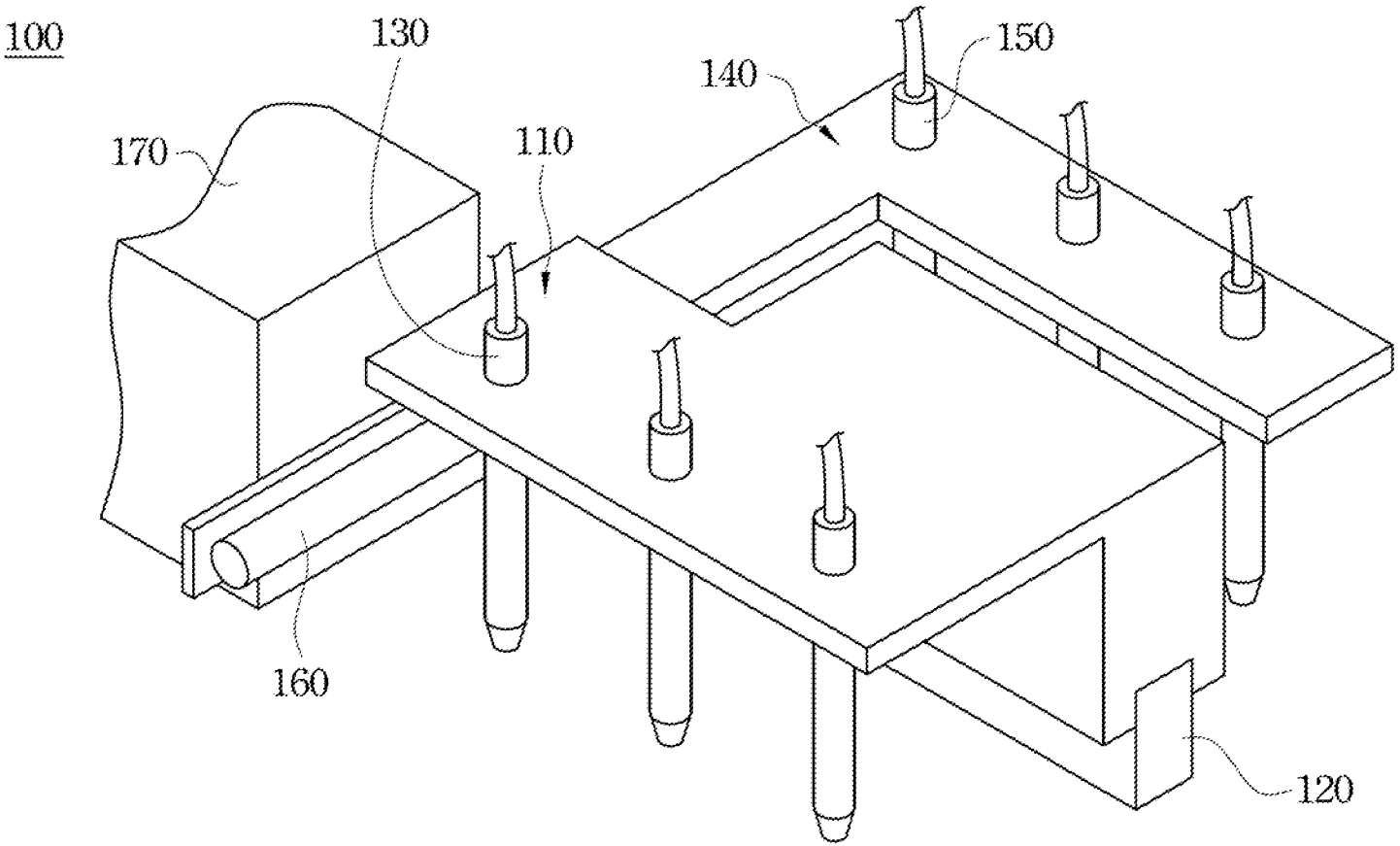
FIG. 1 is a perspective view of a fracturing apparatus of an embodiment of the present invention.
Figure 2:
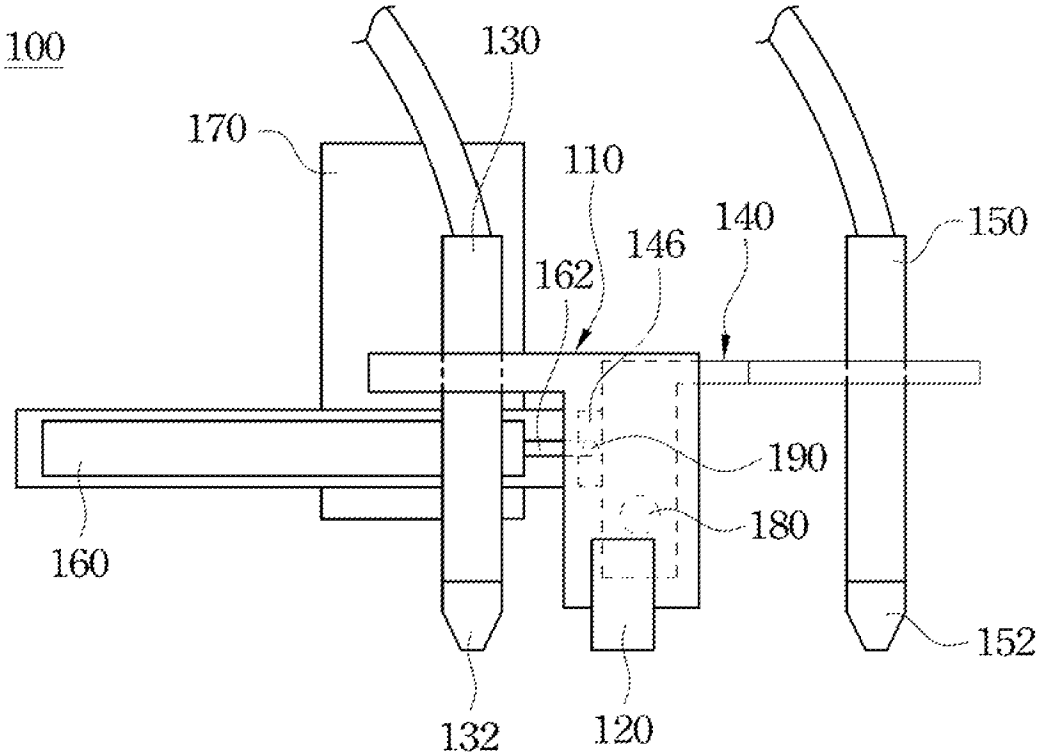
FIG. 2 is a side view of the fracturing apparatus shown in FIG. 1.
Figure 3:
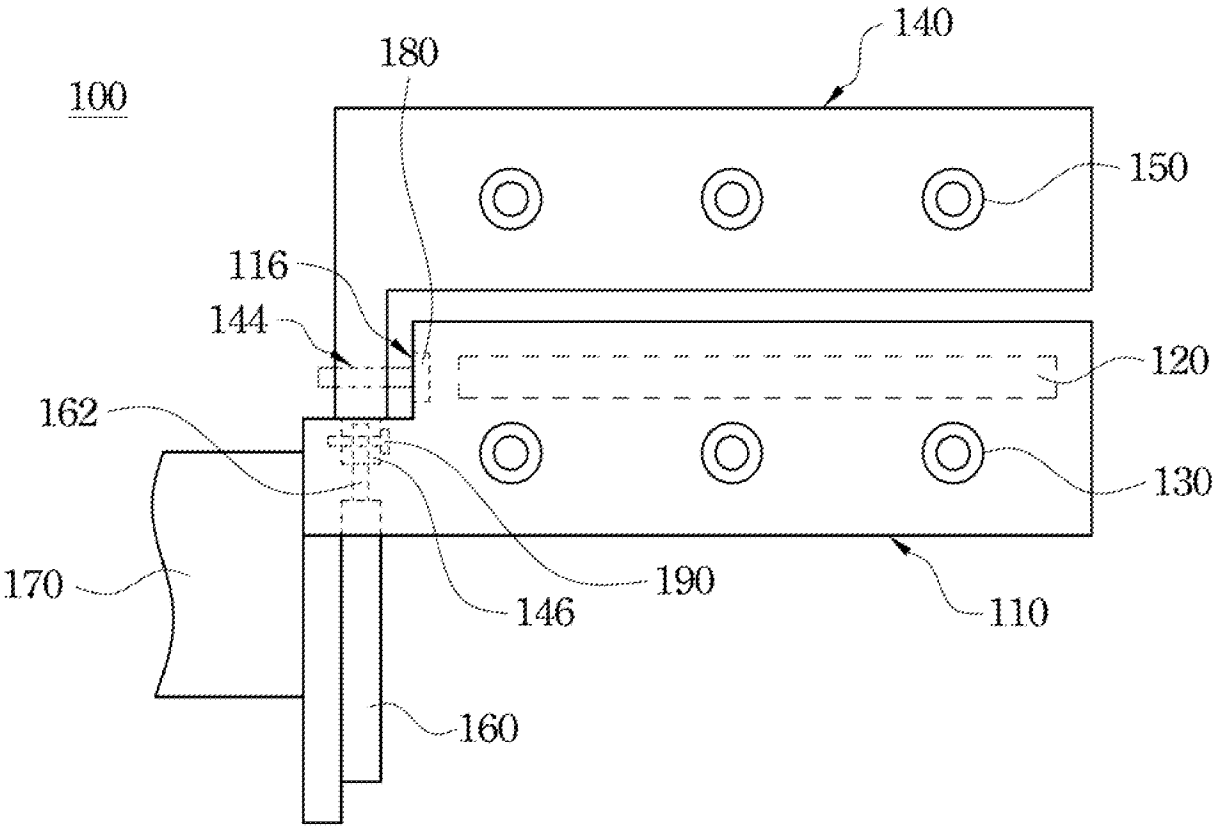
FIG. 3 is a top view of the fracturing apparatus shown in FIG. 1.

FIG. 1 is a perspective view of a fracturing apparatus 100 of an embodiment of the present invention. FIG. 2 is a side view of the fracturing apparatus 100 shown in FIG. 1. FIG. 3 is a top view of the fracturing apparatus 100 shown in FIG. 1. As show in FIG. 1 to FIG. 3, the fracturing apparatus 100 includes a first board portion 110, a pressing element 120, a first suction device 130, a second board portion 140, a second suction device 150, and a cylinder 160. The first suction device 150 is secured to the first board portion 110. The second board portion 140 is rotatably connected to the first board portion 110. The second suction device 150 is secured to the second board portion 140. The pressing element 120 is secured to the first board portion 110 and disposed between the first board portion 110 and the second board portion 140.

The cylinder 160 is located on the first board portion 110 and includes a piston rod 162 rotatably connected to the second board portion 140. When the piston rod 162 extends, the second board portion 140 is pressed by the piston rod 162 and swiveled about the first board portion 110.

In this embodiment, the fracturing apparatus 100 may further include a moving device 170 connected to the first board portion 110, and in response to receiving an electric signal, moves the first board portion 110, as will be described in greater detail below. Because the second board portion 140 is connected to the first board portion 110, the first board portion 110 and the second board portion 140 may move simultaneously.

Moreover, the fracturing apparatus 100 may include a first fixing element 180. The first board portion 110 includes a first positioning hole 116, and the second board portion 140 includes a second positioning hole 144 corresponding to the first positioning hole 116. The first fixing element 180 extends through the first board portion 110 and the second board portion 140 respectively through the first positioning hole 116 and the second positioning hole 144. With such a design, the second board portion 140 may be rotatably connected to the first board portion 110. The first fixing element 180 may be a bolt.

Furthermore, the second board portion 140 may optionally include a connecting part 146 connected to the piston rod 162. A second fixing element 190 may extend through the connecting part 146 and the piston rod 162. In this embodiment, the second fixing element 190 may be a bolt, and the second board portion 140 and the connecting part 146 may be integrally formed (i.e., formed as a single piece). As a result, the piston rod 162 may be rotatably connected to the connecting part 146 of the second board portion 140.

The material of the first board portion 110 and the second board portion 140 may include aluminum or stainless steel. The material of the pressing element 120 may include plastic or rubber.

It is to be noted that much of the information described in the above embodiments will not be repeated in the following description. The following description provides details with respect to the manner in which the fracturing apparatus 100 is used to fracture a substrate having a groove formed therein.

Figure 4:
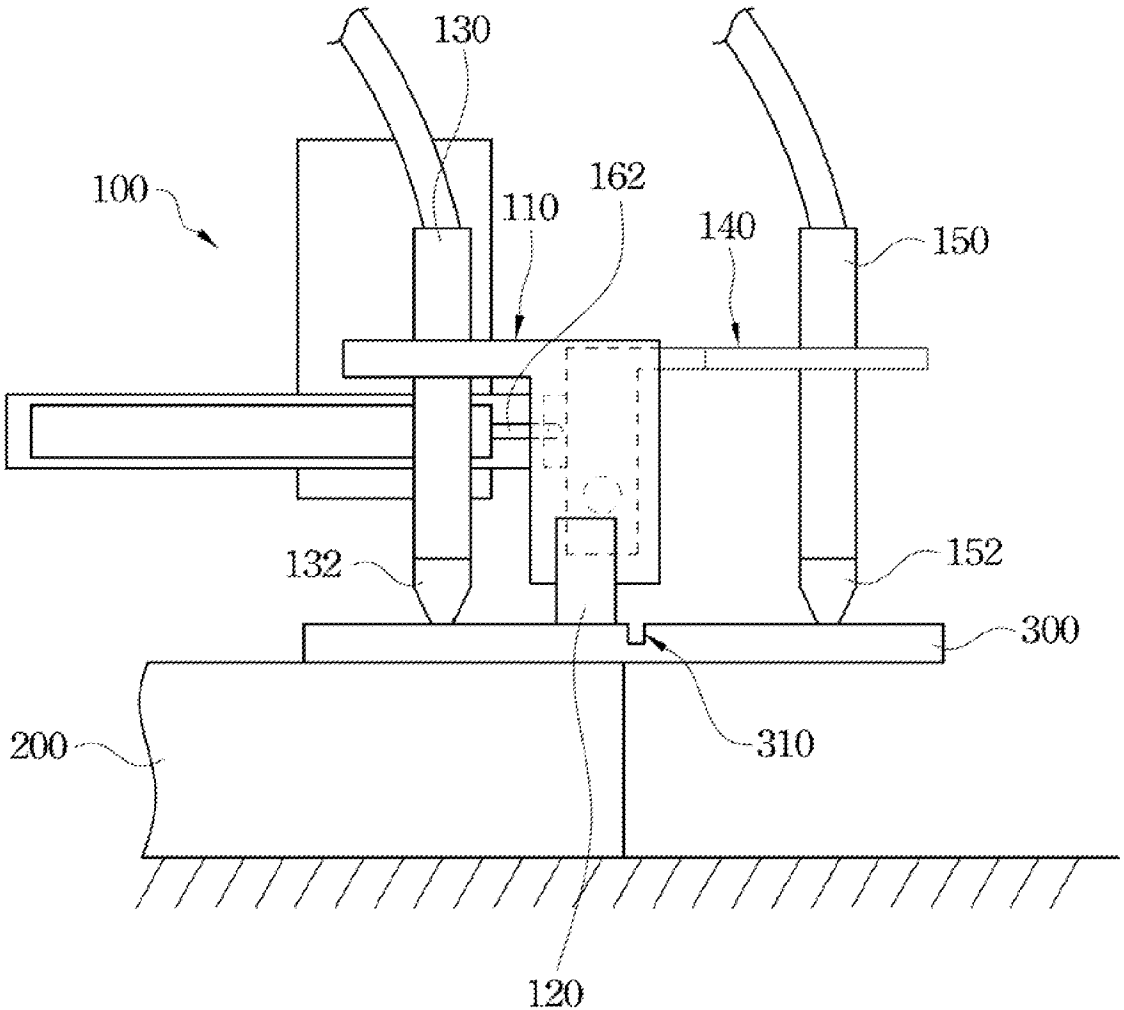
FIG. 4 is a side view of the fracturing apparatus shown in FIG. 1 when a first suction device and a second suction device thereof adhere to a substrate.

FIG. 4 is a side view of the fracturing apparatus 100 shown in FIG. 1 when the first suction device 130 and the second suction device 150 thereof adhere to a substrate 300. As shown in FIG. 4, the first suction device 130 includes a first nozzle 132 and the second suction device 150 includes a second nozzle 152. The first nozzle 132, the second nozzle 152, and the pressing element 120 have respective end surfaces disposed substantially within the same horizontal level when the piston rod 162 does not extend. Therefore, the first nozzle 132, the second nozzle 152, and the pressing element 120 may be in contact with the substrate 300. In this embodiment, the pressing elemeht 120 has a rectangular cross section, and each of the first board portion 110 and the second board portion 140 has an L-shaped cross section.

When the first suction device 130 located on the first board portion 110 and the second suction device 140 located on the second board portion 140 adhere to the substrate 300 having a groove 310 formed therein, the substrate 300 may be placed on a block 200, such that the substrate 300 may be sandwiched between the pressing element 120 and an edge of the block 200. The edge of the pressing element 120 may be adjacent to the groove 310 of the substrate 300, and the edge of the block 200 may be vertically aligned roughly with the edge of the pressing element 120.

In this embodiment, the substrate 300 is a photovoltaic cell which may include transparent conductive oxide. However, in other embodiments, the substrate 300 may be a glass or a polymer sheet.

Figure 5:
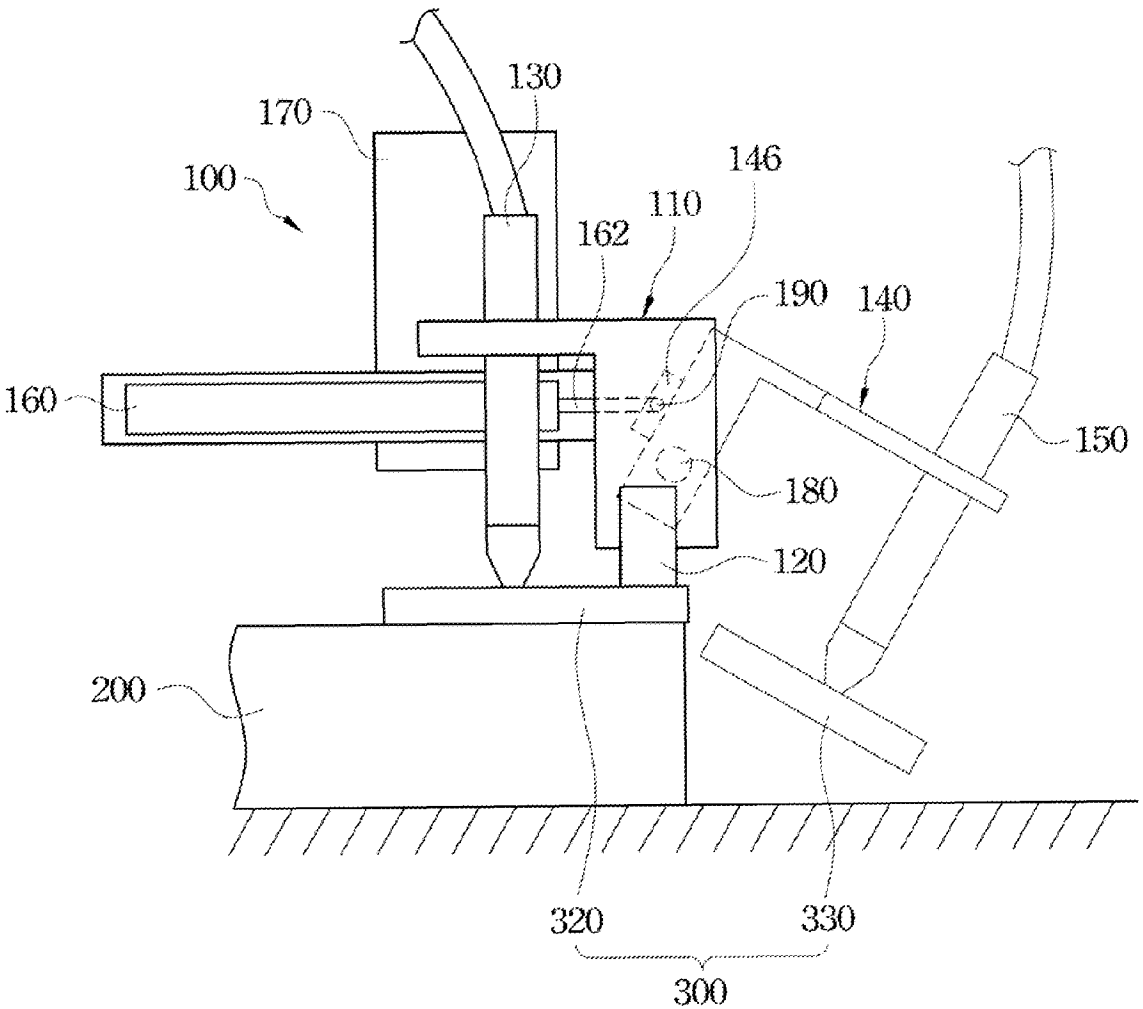
FIG. 5 is a side view of the fracturing apparatus shown in FIG. 4 when a piston rod of a cylinder thereof extends.

FIG. 5 is a side view of the fracturing apparatus 100 shown in FIG. 4 when the piston rod 162 of the cylinder 160 thereof extends. The piston rod 162 of the cylinder 160 may extend in response to the cylinder 160 receiving an electric signal. Consequently, with reference to FIG. 5, the second board portion 140 is pressed by the piston rod 162 and caused to rotate on the first board portion 110 about the first fixing element 180, and the piston rod 162 rotates on the connecting part 146 about the second fixing element 190. Therefore, the substrate 300 is fractured along the groove 310 (see FIG. 4) and divided into two portions 320, 330.

As a result, the portion 320 of the substrate 300 remains sandwiched between the pressing element 120 and the edge of the block 200 and adhered to by the first suction device 130, while the portion 330 of the substrate 300 is adhered to by the second suction device 150.

Figure 6:
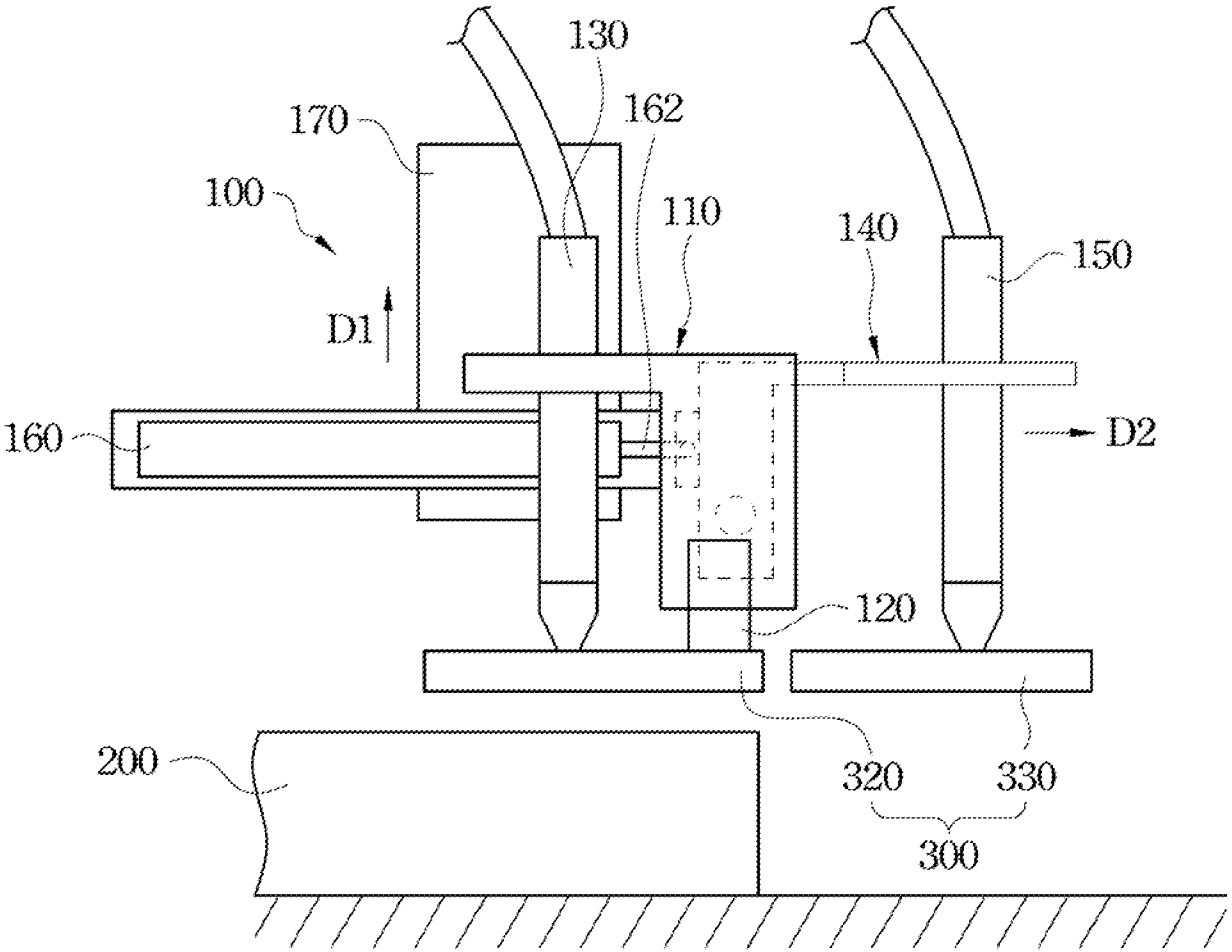
FIG. 6 is a side view of the fracturing apparatus shown in FIG. 5 when the piston rod of the cylinder thereof is retracted after fracturing the substrate.

FIG. 6 is a side view of the fracturing apparatus 100 shown in FIG. 5 when the piston rod 162 of the cylinder 160 thereof is retracted after the substrate 300 is divided into two portions 320, 330. As show in FIG. 6, the substrate 300 has been divided into the portions 320, 330 by the fracturing apparatus 100. The moving device 170 may be controlled by an electric signal to move the first board portion 110 in a direction D1. Since the second board portion 140 is connected to the first board portion 110, the first board portion 110 and the second board portion 140 move simultaneously. As a result, the whole fracturing apparatus 100 moves upward, and the portion 320 of the substrate 300 separates from the block 200.

During this process, the first suction device 130 and the second suction device 150 respectively remain adhered to the portions 320, 330 of the substrate 300. Moreover, the pressing element 120 may remain in contact with the portion 320 of the substrate 300. Subsequently, the moving device 170 may be controlled by another electric signal to move the fracturing apparatus 100 in a direction D2.

Figure 7:
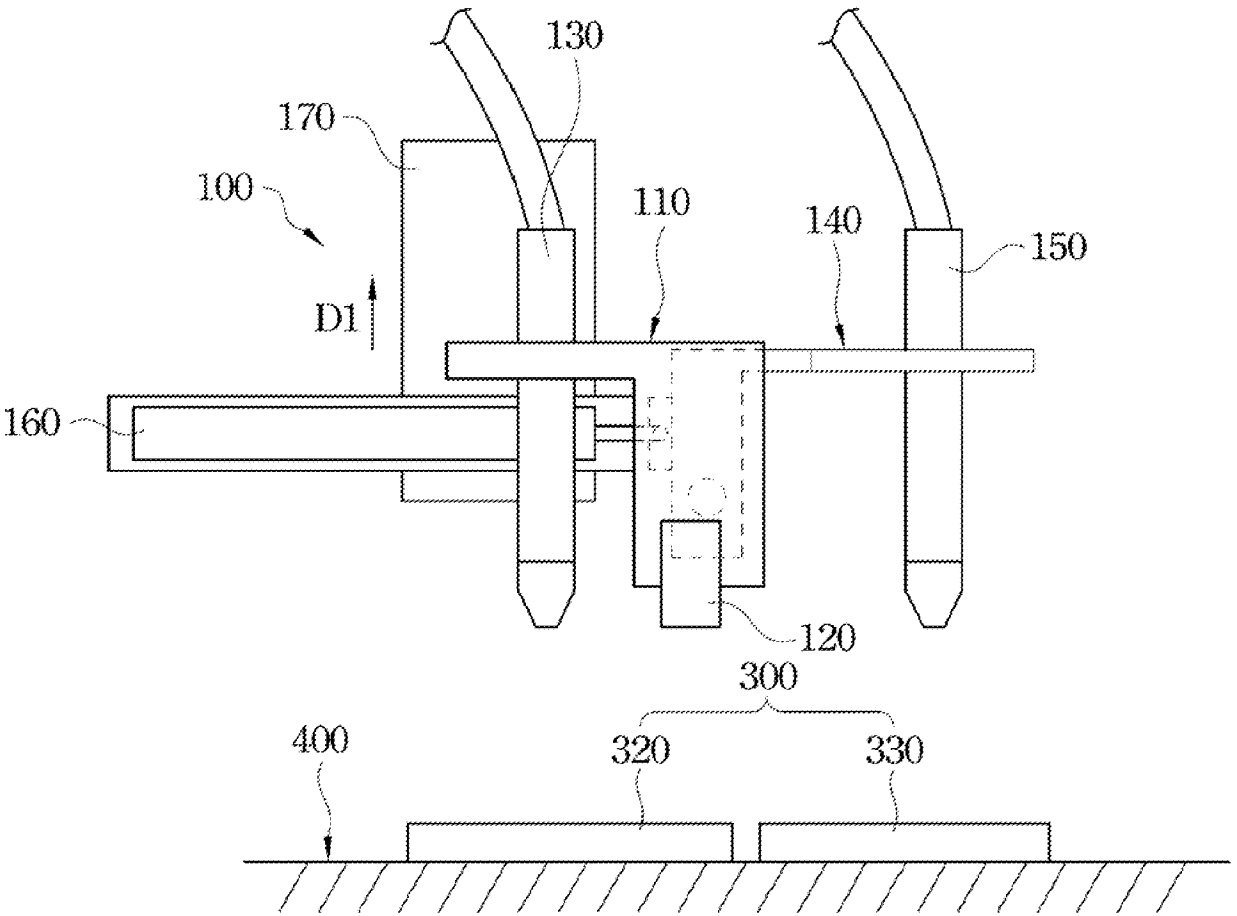
FIG. 7 is a side view of the fracturing apparatus shown in FIG. 6 when the first suction device and the second suction device thereof release two divided portions of the substrate.

FIG. 7 is a side view of the fracturing apparatus 100 shown in FIG. 6 when the first suction device 130 and the second suction device 150 thereof release the two divided portions 320, 330 of the substrate 300. As shown in FIG. 7, when the first suction device 130 and the second suction device 150 respectively release the portions 320, 330 of the substrate 300 after the fracturing apparatus 100 is moved in the direction D2 (see FIG. 6), the portions 320, 330 of the substrate 300 may be placed on a surface 400.

After placing the portions 320, 330 of the substrate 300 on the surface 400, the moving device 170 may be controlled by an electric signal to move the fracturing apparatus 100 in the direction D1, such that the fracturing apparatus 100 is further distanced from the portions 320, 330 of the substrate 300. With such a design of the fracturing apparatus 100 and operation thereof as described above, uneven cracks do not easily form on the substrate 300.

Afterward, the portions 320, 330 of the substrate 300 may be further transmitted for undergoing subsequent processes.

It is to be noted that the sizes of the first board portion 110, the second board portion 140, the first suction device 130, the second suction device 150, the pressing element 120, and the cylinder 160 may be designed in accordance with the size of the substrate 300 to be fractured.

The fracturing apparatus 100 has the following advantages and features:

(1) The substrate having the groove formed therein may be sandwiched between the pressing element and the edge of the block. When the piston rod of the cylinder extends, the second board portion is pressed by the piston rod and swiveled about the first board portion, such that the substrate is easily fractured along the groove and divided into two portions.

(2) The fracturing apparatus including the first suction device, the second suction device, and the cylinder operates automatically to fracture the substrate. As a result, the cut surfaces of the divided substrates are smooth.

(3) When utilizing the fracturing apparatus to fracture a large number of substrates, the quality, yield and capacity of the divided substrates are easy to control.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A fracturing apparatus comprising:

a first board portion;

a first suction device secured to the first board portion;

a second board portion rotatably connected to the first board portion;

a second suction device secured to the second board portion;

a pressing element secured to the first board portion and disposed between the first and second board portion; and a cylinder disposed on the first board portion, wherein the cylinder comprises a piston rod rotatably connected to the second board portion, and when the piston rod extends, the second board portion is pressed by the piston rod and swiveled about the first board portion.

2. The fracturing apparatus as claimed in claim 1 further comprising:

a moving device connected to the first board portion for controlling a moving direction of the first board portion.

3. The fracturing apparatus as claimed in claim 1 further comprising a first fixing element, wherein the first board portion comprises a first positioning hole, the second board portion comprises a second positioning hole corresponding to the first positioning hole, and the first fixing element extends through the first board portion and the second board portion through the first positioning hole and the second positioning hole.

4. The fracturing apparatus as claimed in claim 3, wherein the first fixing element comprises a bolt.

5. The fracturing apparatus as claimed in claim 1, wherein the second board portion comprises a connecting part connected to the piston rod.

6. The fracturing apparatus as claimed in claim 5 further comprising a second fixing element penetrating the connecting part and the piston rod.

7. The fracturing apparatus as claimed in claim 6, wherein the second fixing element comprises a bolt.

8. The fracturing apparatus as claimed in claim 5, wherein the second board portion and the connecting part are formed as a single piece.

9. The fracturing apparatus as claimed in claim 1, wherein the first suction device comprises a first nozzle.

10. The fracturing apparatus as claimed in claim 9, wherein the second suction device comprises a second nozzle.

11. The fracturing apparatus as claimed in claim 10, wherein the first nozzle, the second nozzle, and the pressing element have respective end surfaces disposed substantially within the same horizontal level when the piston rod does not extend.

12. The fracturing apparatus as claimed in claim 1, wherein the material of the first board portion and the second board portion comprises aluminum or stainless steel.

13. The fracturing apparatus as claimed in claim 1, wherein the material of the pressing element comprises plastic or rubber.

14. The fracturing apparatus as claimed in claim 1, wherein the pressing element has a rectangular cross section.

15. The fracturing apparatus as claimed in claim 1, wherein the first board portion has an L-shaped cross section.

16. The fracturing apparatus as claimed in claim 1, wherein the second board portion has an L-shaped cross section.

* * * * *